US011052022B1

(12) United States Patent
DiDomenico

(10) Patent No.: US 11,052,022 B1
(45) Date of Patent: Jul. 6, 2021

(54) RELOADABLE ANTISEPTIC VIAL

(71) Applicant: Lauren DiDomenico, Mount Laurel, NJ (US)

(72) Inventor: Lauren DiDomenico, Mount Laurel, NJ (US)

( * ) Notice: Subject to any disclaimer, the term of this patent is extended or adjusted under 35 U.S.C. 154(b) by 679 days.

(21) Appl. No.: 15/732,299

(22) Filed: Oct. 20, 2017

Related U.S. Application Data

(60) Provisional application No. 62/496,676, filed on Oct. 25, 2016.

(51) Int. Cl.
*A61J 1/14* (2006.01)
*A61J 1/20* (2006.01)
*A61J 1/18* (2006.01)

(52) U.S. Cl.
CPC ..... *A61J 1/1443* (2013.01); *A61J 1/1406* (2013.01); *A61J 1/1418* (2015.05); *A61J 1/2096* (2013.01); *A61J 1/18* (2013.01)

(58) Field of Classification Search
CPC ..... A61J 1/1443; A61J 1/1418; A61J 1/1425; A61J 1/1431; A61J 1/1468; A61J 1/1406; A61J 1/2089; A61J 1/2096; A61J 1/18; A61J 1/145; A61J 1/1456; A61J 1/1412; A61J 1/1475
See application file for complete search history.

(56) References Cited

U.S. PATENT DOCUMENTS 5,792,120 A * 8/1998 Menyhay ..... A61M 39/162 604/256
7,815,611 B2 * 10/2010 Giambattista ..... A61M 5/3202 604/192
8,231,587 B2 * 7/2012 Solomon ..... A61M 25/0097 604/265
8,491,546 B2 * 7/2013 Hoang ..... A61M 39/02 604/267
8,523,830 B2 * 9/2013 Solomon ..... A61M 39/162 220/380
8,647,326 B2 * 2/2014 Solomon ..... A61M 39/162 422/28
9,039,989 B2 * 5/2015 Liu ..... A61M 39/162 422/300
9,192,449 B2 * 11/2015 Kerr ..... A61M 39/20
9,283,369 B2 * 3/2016 Ma ..... A61M 39/20
9,814,650 B1 * 11/2017 Dailey ..... A61J 1/18
2010/0200017 A1 * 8/2010 Kerr ..... A61B 1/122 134/6
2013/0061874 A1 * 3/2013 Woolery ..... B08B 1/00 134/6
2013/0171030 A1 * 7/2013 Ferlic ..... A61M 39/20 422/119
2016/0287478 A1 * 10/2016 Fernandez ..... A61J 1/2096
2017/0232121 A1 * 8/2017 Chiu ..... B08B 3/00 422/28
2018/0064604 A1 * 3/2018 Drmanovic ..... A61L 2/18
2018/0085568 A1 * 3/2018 Drmanovic ..... A61M 39/162

* cited by examiner

*Primary Examiner* — Philip R Wiest

(57) ABSTRACT

Medical vials and bottles containing medications dispensable syringes and needles are interfaced to replaceable caps having alcohol infused wipes therein to sterilize the rubber hubs through which the needles will be inserted into the vials to draw out the medication therefrom.

16 Claims, 2 Drawing Sheets

RELOADABLE ANTISEPTIC VIAL

RELATED CASES

This disclosure claims the benefit of U.S. Provisional Patent Application Ser. No. 62/496,676 filed on Oct. 25, 2016 entitled Reloadable Antiseptic Vial, the teachings of which are incorporated herein by reference.

FIELD

This disclosure relates generally to antiseptic swabs for medicine bottles. More specifically, the disclosure relates to medicine bottles with caps that can be used to contain and dispense medication in a fashion wherein the caps are easily sterilized, thereby making is possible for personnel dispensing the medication to ensure that a sterile environment is easily maintained.

BACKGROUND

Medications by subcutaneous and intramuscular injections are given frequently in the hospital and home setting. These medications can be anything from insulin, to blood pressure medication and even blood thinners. Many of the medications given are from what is known as multi-dose vials. Multi-dose vials contain multiple dosages of a patient's medicine in one vial. Patients can sometimes be receiving medications by injections up to four times a day if not more from multi-dose vials.

Nurses and other medical professionals are charged with dispensing these medications in a hospital, office or other medical environment in a clean, efficient and safe manner. Most often, the medications are stored in a bottle with a rubberized top in which a needle is placed to access the medication stored in the bottle. The rubberized tops are thus subject to contamination which requires decontamination before each use.

Additionally, the bottles containing the medication are often stored in a common area or even a refrigerator so that the medical personnel have common access to them on different shifts so as not to waste the medication and to make the medication continuously available. While this is a necessary and practical consequence of the storage, dispensing and maintenance of medications in the medical environment, it invites careless attention to detail when shifts change, when medical personnel must share the bottles, or when emergency situations make it difficult to retrieve sterilization paraphernalia such as alcohol, cotton pads or alcohol swabs to achieve sterilization or decontamination of the rubberized surfaces. In such cases, unfortunately patients may be exposed to germs, bacteria or other deleterious consequences of a non-sterile medication bottle or dispensing system.

The problem that is inherent in this arrangement is that every time a needle is inserted into a multi-dose vial a tiny hole is created through which bacteria enters. Typically, alcohol swabs are used to sterilize the patient's skin and to sterilize the tops of the vials; however, this protocol does not prevent bacteria from entering the vials themselves. For example, insulin is one of the most widely used medications in the hospital and home settings. According to the NCBI.gov, 340 million people globally have diabetes. High blood sugar and diabetes affects 38-46% of all non-critically ill patients in the hospital. This statistic shows that a little less than half of the patients in the hospital are being treated with an insulin medication. A typical 3 ml vial used consists of 100 units per milliliter. Sliding scales are most commonly used to determine the amount of insulin to be given and therefore dosage amounts on the sliding scale usually start at 2 Units and go up to 8-10 Units. Thus, if about half of the patients in the hospital setting are receiving insulin injections and only 2-10 units are being used per patient and the standard vials the hospitals use are 3 ml's, the amount of needle sticks into this vial of medication that cannot be recapped is between 30 and 150 times.

These uncapped vials that have tiny holes from multiple needle sticks are then placed back in the Pyxis or other areas, such as nurses' pockets at times and wide open for bacteria to enter in to these holes. Protocols in the hospital suggest that you clean the top of the hub with an alcohol swab and wait 30 seconds for it to completely dry before you insert the needle. If this step is accidentally skipped in an emergency situation which is extremely time consuming the top of the vial may be sterilized but the bacteria that has already entered the vial while the vial was uncapped for so long has not been removed by the sterilization protocol. As the vials are pierced multiple times in this way, it is clear that bacteria may continuously enter the vial and cause dangerous contamination.

The deleterious effects that result from this state of affairs is that infections will be produced from the contaminated vials, syringes and injections, which may produce abscesses, pseudomonas, streptococcus, enterococcus bloodstream infection, HIV, HBV, HCV and MRSA. While it is important to use single-dose vials rather than multi-dose vials whenever possible and the use of medicinal preservatives tend to reduce the survival of bacteria, multi-dose vials remain prone to bacterial contamination and the use of multi-dose vials has been reported to be a potential source of infection.

SUMMARY

To solve the aforementioned and other problems, a sterile cap is provided that can be used to recap a multi-dose vial after use. The cap can be a flexible, nonporous plastic that is disposable so a fresh sterile cap can be used each time. Alternatively, the cap may have a replaceable sterile material that re-sterilizes the bottle after each use when the cap is replaced on the bottle or vial, and in this case when all of the sterile materials are used, the cap may be replaced. The cap will fit over top of the vial top, holding snugly around the vial neck. Inside of the cap, resting on the rubber hub will be an infused alcohol swab to ensure the top stays sterile at all times.

The concept will be best understood by reading the following detailed description in conjunction with the drawings first described briefly below.

DETAILED DESCRIPTION

Figure 1:
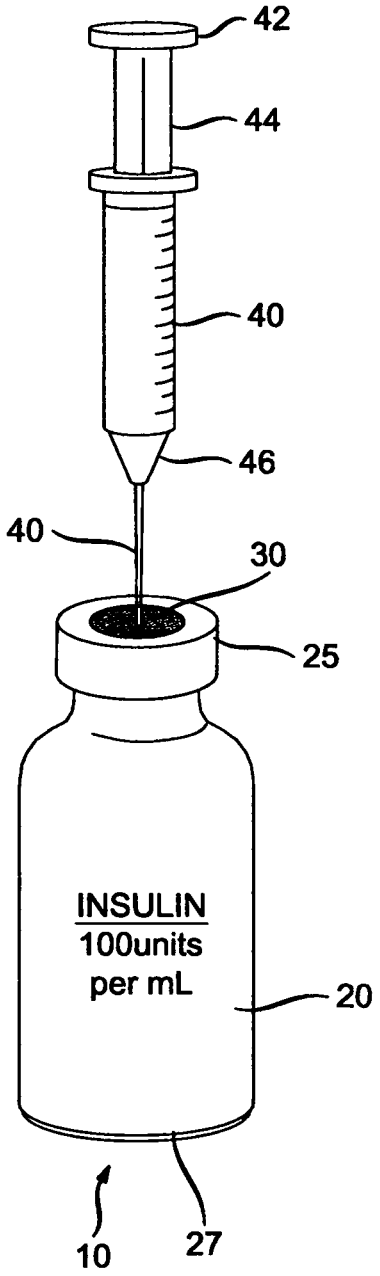
FIG. 1 is a schematic view of a medicine vial with a rubber or rubberized top surface adapted to receive a syringe which pierces the top surface thereby enabling the syringe to draw medication from the medicine vial.

Referring now to the drawings where like reference numerals refer to like elements, FIG. 1 depicts a medicine vial or bottle 10 filled with a fluid or fluidized medication or medicament 20. The medication 20 is, for example, insulin, but may be any medicine, usually in fluid form which may be drawn out of the vial 10 to be administered to a patient by a nurse, doctor, or other medical professional. As is known, the vial 10 has a proximal end 25 opposite a distal end 27 on which a rubber material 30 is molded or otherwise formed so as to retain the medicine 20 in the bottle 10. Such vials are available from the Hospira Company, for example.

Conventionally, the medical professional uses a syringe 40 to pierce the rubber material 30 in order to draw the medicine 20 from the vial. Syringe 40 has a distal end 42 terminating in a plunger 44, and a proximal end 46 from which a needle 48 is affixed. As is also conventional, the medical professional pierces the needle 48 in to rubber top 30 so as to extend the needle 48 into the interior of the vial 10 and contact the medicine 20 and then draws plunger 44 upward away from the vial 10 to pull the medicine 20 into the syringe body in an amount necessary to provide an efficacious amount of the medicine for the patient when the medicine 20 is injected into the patient. In the case when the medicine 20 is, for example, insulin, the patient may also use the syringe 40 to self-administer the insulin.

Figure 2:
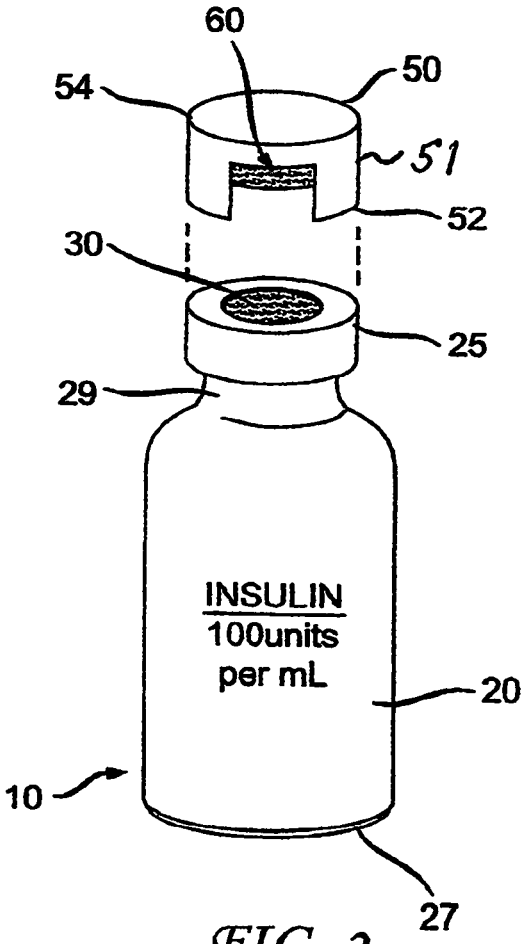
FIG. 2 is a schematic view of a medicine vial which has a rubber or rubberized top to receive needles and which can hold an amount of medication to be dispensed to a patient though a needle inserted through the rubberized top so that the needle can draw a desired amount of medication for administering to the patient, and a cap to fit over the vial of FIG. 1 having a sterilizing wipe attached to bottom portion of the cap and which can interface snugly with the rubberized top of the vial, wherein the cap may be disposable after each administration of the medication or the cap may be reusable when the sterilizing wipe is replaceable in the reusable cap after each administration of the medication.
Figure 3:
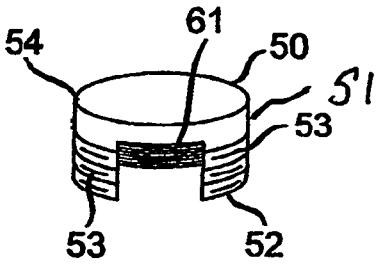
FIG. 3 is a schematic view of a cap having a body and threads.

Referring now to FIGS. 2 and 3, it is shown that the bottle 10 may be interfaced with cap 50 having a body 51, a distal end 52 and a proximal end 54. Preferably, cap 50 fits snugly around the vial neck 29 which is below the proximal end 25 of the vial or bottle 10. When the user of the vial 10 pushes downward on the proximal end 54 of the cap, the cap comes inward to seal around neck 29.

In use, cap 50 is flipped off the proximal end 25 of vial 10 and underneath is the rubber piece 30, sometimes called the "hub", which is where needle 48 will enter. After the plastic cap 50 is flipped off, it is not reusable and must be discarded. The uncapped vial 10 is thus left exposed on the rubber hub 30 and will be used for multiple patients, multiple medication dosages and thus ultimately containing multiple holes through which bacteria may be enter, thereby causing the multiple dangerous health concerns mentioned above. Caps 50 come in different sizes, for example 13 mm and 20 mm and these two sizes will cover vials anywhere from 1 milliliter to 100 milliliters in capacity. These caps can be color coordinated so patients/nurses will have no problems identifying the different levels of medications. For example, red caps are for high risk medications, yellow caps for insulins, etc.

In order to prevent bacterial from entering the multiple holes pierced in hub 30 due to multiple uses of the vial 10, sterile wipe 60 is provided to cap 50 underneath the proximal end 54 so that when cap 50 is pressed or snapped on to the proximal end 25 of vial 10, the sterile wipe 60 comes into contact with hub 30 and sterilizes hub 30. Sterile wipe 60 may be, for example, an alcohol infused wipe made of cotton or some other conventionally absorbing material. Alternatively, the sterilizing material may be for example, peroxide, iodine, or any other sterilizing fluid approved for sterilizing medical equipment and vials 10. The appropriate substrate to absorb and support the sterilizing fluids, such as cotton and other swabbing materials may be used.

To use the caps 50 in this manner, the nurse, medical professional or patient uncaps the vials 10 from an original plastic seal in which the vial 10 is packaged and inserts a brand new, sterile needle 48 into the rubber hub 30 to draw the medication 20 from vial 10. The needle 48 is then removed from hub 30 and vial 10 and a brand new cap 50, which has similarly been medically packaged before use, is obtained and placed over the proximal end 25 of vial 10 so that cap 50 is snugly held around neck 29.

In this fashion, cap 50 having infused wipe 60 prevents any bacteria from entering into vial 10 and will also keep the rubber hub 30 sterile until the next use. When it is time to use vial 10 again, new cap 50 is simply removed from vial 10 and discarded. At this time the rubber hub is already sterile and ready for use. Alternatively, as shown particularly in FIG. 3 a plurality of wipes 61 can be placed into cap 50 and each wipe discarded after new uses of vial 10. In such case, the cap 50 is not discarded and replaced until all such wipes 61 have been exhausted at which point a new single use or multiple use cap may be used. Alternatively, cap 50 could be held onto vial 10 by a hinge or in a hinged arrangement by any number of mechanisms for achieving a hinging-type securing of the cap to the vial. Also, the cap could be threaded 53 in the interior of the distal end 52 of body 51, in which case the vial 10 would have threads so that the cap 50 can be screwed down onto the vial. Other securing arrangements of cap 50 to vial 10 could be a simple tether or ring arrangement which allows the ring to fit over the top of the vial so that it does not become easily detached therefrom. In any such arrangement when the sterile wipe or wipes are depleted, the cap 50 may be discarded and a new cap placed on vial 10.

The present vials 10 and caps 50 will not only help prevent bacteria from getting in to the medication 20, but will also keep the rubber hubs 30 sterile and ready for use at all times. This eliminates the time spent wiping the hub with alcohol and waiting 30 seconds for it to be dry. It keeps patients safe, prevents infections, therefore, reducing hospital costs, eliminates time consuming protocols and is easy to use.

There have thus been described certain preferred embodiments of methods and apparatus for dispensing medications and providing sterilized medical vials with caps therefor. While preferred embodiments have been described and disclosed, it will be appreciated by those with skill in the art that modifications are within the true spirit and scope of the described principles.

What is claimed is:

1. A cap comprising:

a body adapted to hold a sterile material therein;

a distal end adapted to cover a vial having medication therein and to seal the cap to the vial;

a proximal end from which a user may cause the cap to seal the distal end around a hub of the vial, wherein the hub has a top surface through which a needle may be placed allowing the medication to be drawn from the vial; and a space in the distal end adapted to store the sterile material so that the sterile material will touch the entire top surface of the hub of the vial when the distal end is mated to the hub when the user has caused the proximal end to seal the distal end on the hub, wherein the cap is removeable from the vial by the user, and the sterile material sterilizes the hub and is discarded after use to sterilize the hub of the vial and replaceable in the cap after each administration of the medication.

2. The cap recited in claim 1, further comprising a sterile material in the space.

3. The cap recited in claim 2, wherein the sterile material comprises a wipe infused with a sterilizing substance.

4. The cap recited in claim 3 wherein the sterile substance is chosen from the group consisting essentially of alcohol, peroxide, or iodine.

5. The cap recited in claim 4, further comprising threads on the distal end to allow the user to seal the cap to the vial when the vial has reciprocating threads.

6. The cap recited in claim 2, wherein the sterile material comprises a plurality of wipes wherein each of the plurality of wipes may be discarded after use of the wipe to sterilize the hub of the vial.

7. A sterile arrangement for dispensing medication to a patient comprising:

a vial adapted to be filled with a medication that may be dispensed to a patient and which may be drawn from the vial, the vial having a distal end and a proximal end, and a neck between the proximal end and the distal end of the vial;

a hub on the proximal end of the vial, the hub having a top surface through which a needle may be placed allowing the medication to be drawn from the vial;

a material on the hub through which the medication may be drawn;

a cap comprising a body adapted to hold a sterile material therein, the cap further comprising;

a distal end adapted to cover the hub of the vial, and to seal the cap to the vial;

a proximal end from which a user may use to cause the cap to seal the distal end around the hub of the vial; and a space in the distal end of the cap adapted to store the sterile material so that the sterile material will touch the entire top surface of the hub of the vial when the distal end is mated to the hub when the user has caused the proximal end to seal the distal end on the hub, wherein the cap is removeable from the vial by the user, and the sterile material sterilizes the hub and is discarded after use to sterilize the hub of the vial and replaceable in the cap after each administration of the medication.

8. The sterile arrangement recited in claim 7, further comprising a sterile material in the space.

9. The sterile arrangement recited in claim 8, wherein the sterile material comprises a wipe infused with a sterilizing substance.

10. The sterile arrangement recited in claim 9 wherein the sterile substance is chosen from the group consisting essentially of alcohol, peroxide, or iodine.

11. The sterile arrangement recited in claim 10, further comprising threads on the distal end of the cap to allow the user to seal the cap to the vial when the vial has reciprocating threads.

12. The sterile arrangement recited in claim 8, wherein the sterile material comprises a plurality of wipes wherein each of the plurality of wipes may be discarded after use of the wipe to sterilize the hub of the vial.

13. The sterile arrangement recited in claim 7, wherein the material on the hub through which the medication may be drawn comprises a material which may be pierced by a syringe needle.

14. The sterile arrangement recited in claim 13, wherein the material which may be pierced by the syringe needle is rubber.

15. The sterile arrangement recited in claim 14, further comprising the medication.

16. The sterile arrangement recited in claim 15, wherein the medication is insulin.

* * * * *